US009221646B1

(12) United States Patent
Amara

(10) Patent No.: US 9,221,646 B1
(45) Date of Patent: Dec. 29, 2015

(54) COMBINED ALUMINUM AND PLASTIC FOOD WRAP AND ASSOCIATED USE THEREOF

(71) Applicant: Tony Simeon Amara, Long Beach, CA (US)

(72) Inventor: Tony Simeon Amara, Long Beach, CA (US)

( * ) Notice: Subject to any disclaimer, the term of this patent is extended or adjusted under 35 U.S.C. 154(b) by 216 days.

(21) Appl. No.: 14/178,219

(22) Filed: Feb. 11, 2014

Related U.S. Application Data

(60) Provisional application No. 61/763,086, filed on Feb. 11, 2013.

(51) Int. Cl.
*B65H 35/00* (2006.01)
*B65D 85/672* (2006.01)
*B65H 16/00* (2006.01)

(52) U.S. Cl.
CPC ..... *B65H 35/002* (2013.01); *B65D 85/672* (2013.01); *B65H 16/005* (2013.01); *B65H 35/008* (2013.01)

(58) Field of Classification Search
CPC .. B65H 35/002; B65H 35/008; B65H 16/005; B65D 85/672
See application file for complete search history.

(56) References Cited

U.S. PATENT DOCUMENTS 1,137,278 A * 4/1915 Peterson ..... C09J 7/04 428/191
2,607,504 A * 8/1952 Sonnenberg ..... B65D 41/14 101/32
3,011,383 A * 12/1961 Sylvester ..... G02B 1/10 359/360
3,329,547 A * 7/1967 Denenberg ..... B32B 15/08 156/247
3,445,055 A * 5/1969 Port ..... B65D 29/00 139/389
3,454,419 A * 7/1969 Deretchin ..... B32B 27/00 427/402
3,526,000 A * 8/1970 Williams ..... B29C 43/305 156/244.22
3,560,223 A * 2/1971 Turbak ..... B65B 25/001 426/105
3,575,762 A * 4/1971 Goehring ..... B32B 15/08 156/244.23
3,964,669 A * 6/1976 Sontag ..... B65D 75/28 220/62.13
3,976,528 A * 8/1976 James ..... B29C 65/028 156/244.11
3,985,604 A * 10/1976 Balla ..... B29C 65/3656 156/244.17
3,996,049 A * 12/1976 Rochlitz ..... G03G 5/047 430/128
4,014,158 A * 3/1977 Rausing ..... B65B 43/52 53/110
4,069,081 A * 1/1978 Drower ..... B32B 37/00 156/273.3
4,698,246 A * 10/1987 Gibbons ..... B32B 27/10 426/127
4,754,914 A * 7/1988 Wischusen, III ..... A47G 21/001 229/87.08
5,164,141 A * 11/1992 Becker ..... B29C 70/086 156/309.6
6,273,984 B1 * 8/2001 Bourdelais ..... B32B 37/0007 156/244.22
7,614,331 B2 * 11/2009 Schaefer ..... A47F 7/17 225/6
7,987,758 B2 * 8/2011 Chabansky ..... B26D 1/045 83/614
2004/0040429 A1 * 3/2004 Nichols ..... B26D 1/045 83/455
2004/0065575 A1 * 4/2004 Gerulski ..... B65D 83/0805 206/395
2004/0144882 A1 * 7/2004 Small ..... B65B 67/08 242/559
2004/0194601 A1 * 10/2004 Lin ..... B26D 7/22 83/650
2007/0000935 A1 * 1/2007 Pavlik ..... B26D 1/045 221/33
2010/0320250 A1 * 12/2010 Hideoka ..... B26F 3/02 225/91
2011/0108599 A1 * 5/2011 Nottingham ..... B65H 35/002 225/77
2014/0263527 A1 * 9/2014 Mukohara ..... B65D 25/20 225/43
2015/0266692 A1 * 9/2015 Tiedemann ..... B65H 35/0033 156/577

OTHER PUBLICATIONS

Wiley WileyEncyclopedia of packaging technology ch6 (2010).*

* cited by examiner

*Primary Examiner* — Sean Michalski

(57) ABSTRACT

An aluminum and plastic food wrap dispensing apparatus includes a dispenser, and a double-ply body having a foil layer and a plastic layer directly attached thereto wherein the double-ply body has a smooth top surface and a smooth bottom surface. Such a double-ply body is in rotatable communication with the dispenser such that the double-ply body is freely unrolled when pulled away from the dispenser.

5 Claims, 4 Drawing Sheets

COMBINED ALUMINUM AND PLASTIC FOOD WRAP AND ASSOCIATED USE THEREOF

CROSS REFERENCE TO RELATED APPLICATIONS

This application claims the benefit of U.S. Provisional Application No. 61/763,086 filed Feb. 11, 2013, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to food preservation products and, more particularly, to a food wrap including two separate plies that are bonded together to create the ideal food wrapping material. One ply is composed of regular aluminum foil, and the other of plastic cling film.

2. Prior Art

Wrapping food items for storage is an important part of modern kitchen craft. From home kitchens to large, institutional cooking halls, it's always important to properly wrap and cover dishes of leftover food before putting them away in the refrigerator or freezer. This process can involve the use of a variety of materials, with aluminum foil and plastic cling film being two of the most popular. These simple products are easy to apply, providing a valuable way to seal in moisture and seal out competing flavors and odors that may compromise a dish's overall palatability. While either one or the other of these handy materials will provide a minimal functional barrier, it is common practice in many institutional kitchens to use both, applying first a layer of plastic cling film, and then one of aluminum foil.

The benefits of double wrapping provide an air-tight seal of the cling film with the structural integrity of the foil. This double wrapping is also used in a variety of meal preparations, especially those that rely on braising. Foil applied over cling film provides an ideal sealing cover for all manner of preparations, from braised ribs to broiled macaroni and cheese.

Applying both coverings in turn, however, can be a rather labor intensive process, especially when one is tasked with preparing many different servings of a given dish. Aluminum and plastic food wrap was developed by a lead cook from the catering services at Universal Studios Hollywood. Having found that he and his staff were often tasked with double wrapping dishes in both plastic cling wrap and aluminum foil, he reasoned that the entire operation could be significantly streamlined by combining the two products on a single roll. The result is a highly air-tight and structurally stable product that's ideal for home and institutional kitchens alike, as useful for cooking as it is for sealing away leftovers.

Accordingly, a need remains for food preservation food wrap in order to overcome at least one prior art shortcoming. The exemplary embodiment(s) satisfy such a need by providing a food wrap including two separate plies that are bonded together to create the ideal food wrapping material that is convenient and easy to use, lightweight yet durable in design, versatile in its applications, and designed for providing a double-ply food wrap having aluminum foil and plastic cling film.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an aluminum and plastic food wrap dispensing apparatus. These and other objects, features, and advantages of the non-limiting exemplary embodiment(s) are provided by the aluminum and plastic food wrap dispensing apparatus including a dispenser, and a double-ply body having a foil layer and a plastic layer directly attached thereto wherein the double-ply body has a smooth top surface and a smooth bottom surface. Such a double-ply body is in rotatable communication with the dispenser such that the double-ply body is freely unrolled when pulled away from the dispenser.

In a non-limiting exemplary embodiment, the dispensing apparatus further includes a carrying case. Notably, the dispenser is removably housed within the carrying case, and remains statically seated within the carrying case while the double-ply body is rotatably unwound from the dispenser.

In a non-limiting exemplary embodiment, the foil layer includes aluminum foil.

In a non-limiting exemplary embodiment, the plastic layer includes plastic cling film having adhesive characteristics adhered to the aluminum foil.

In a non-limiting exemplary embodiment, the aluminum foil is bonded to the plastic cling film.

In a non-limiting exemplary embodiment, the aluminum foil is laminated to the plastic cling film.

In a non-limiting exemplary embodiment, the dispenser includes a linear spool traveling along a major longitudinal length of the carrying case. First and second anchors are statically affixed to proximal and distal ends of the linear spool respectively. Each of the first and second anchors includes a slot extending outwardly and away from an outer perimeter wall thereof, respectively. A cutting blade has serrated teeth juxtaposed side-by-side along a linear travel path of the cutting blade extending parallel to a longitudinal length of the spool. In this manner, proximal and distal ends of the cutting blade are removably nested within a corresponding one of the slots.

In a non-limiting exemplary embodiment, anterior and posterior sides of the cutting blade are registered parallel to each of the slots such that the double-ply body traverses the serrated teeth when unrolled from the spool. Advantageously, each of the slots is registered along a vertical plane and the double-ply body is extracted from the carrying case along a general horizontal plane.

In a non-limiting exemplary embodiment, the double-ply body includes a single sheet of the aluminum foil and a single sheet of the plastic cling film abutted thereagainst in a continuous roll wound to a cylindrical configuration.

The present disclosure further includes a method of utilizing an aluminum and plastic food wrap dispensing apparatus. Such a method includes the steps of: providing a dispenser; providing a double-ply body having a foil layer and a plastic layer directly attached thereto wherein the double-ply body further has a smooth top surface and a smooth bottom surface; and rotatably communicating the double-ply body with the dispenser such that the double-ply body is freely unrolled when pulled away from the dispenser.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
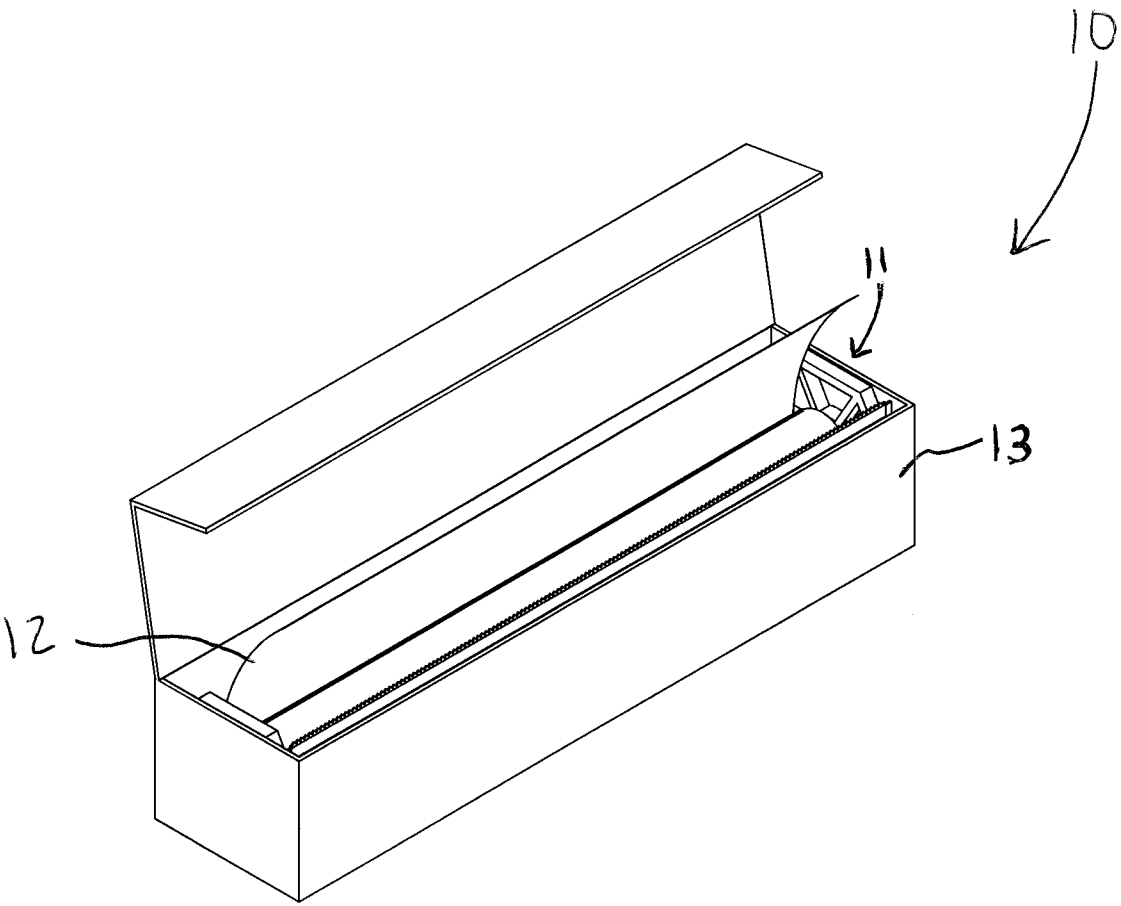
FIG. 1 is a perspective view of an aluminum and plastic food wrap dispensing apparatus seated within a carrying container, in accordance with an exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment (s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Figure 2:
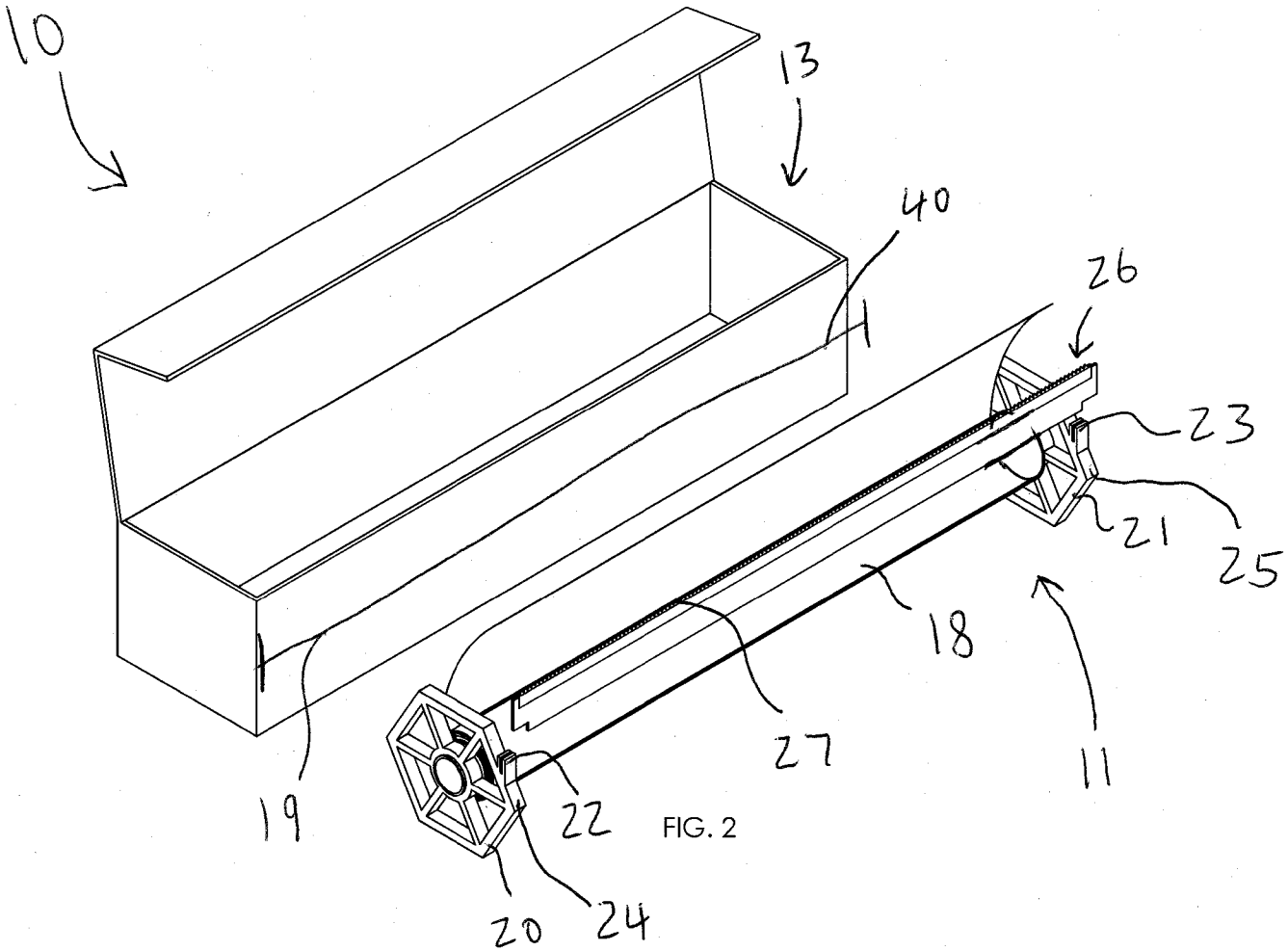
FIG. 2 is a perspective view of the aluminum and plastic food wrap dispensing apparatus, of FIG. 1, removed from the carrying container.
Figure 4:
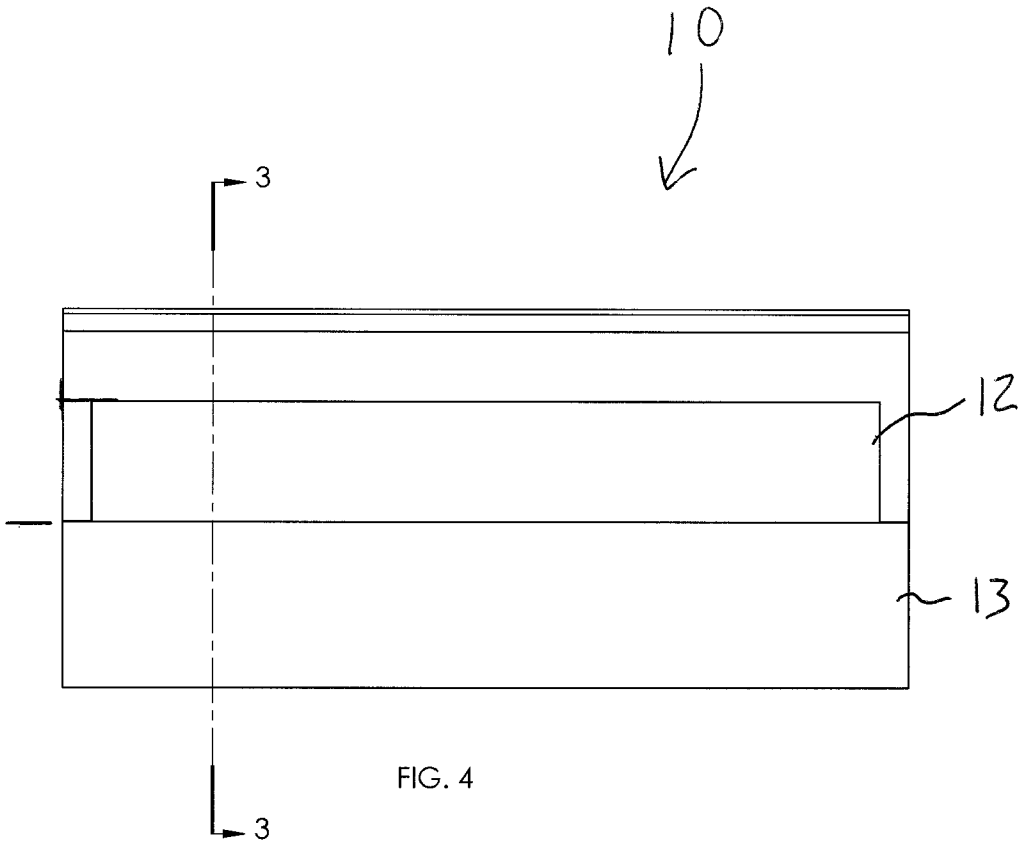
FIG. 4 is a front elevational view of the aluminum and plastic food wrap dispensing apparatus and carrying container shown in FIG. 1.
Figure 3:
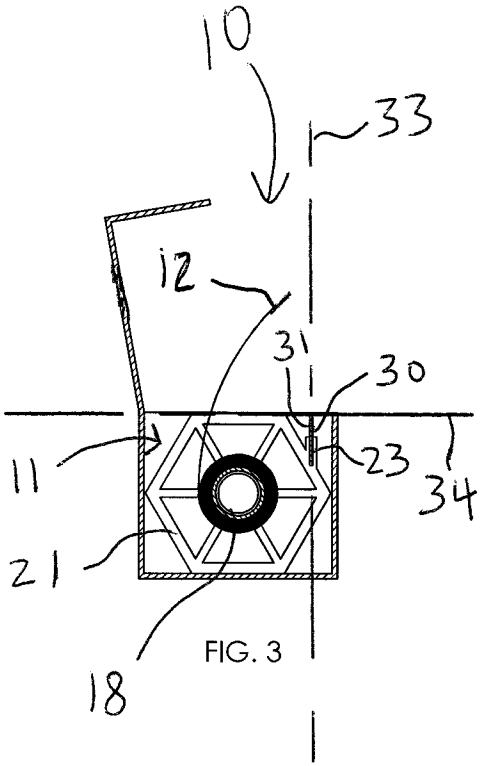
FIG. 3 is a cross-sectional view taken along line 3-3 in FIG. 4.
Figures 5, 6:
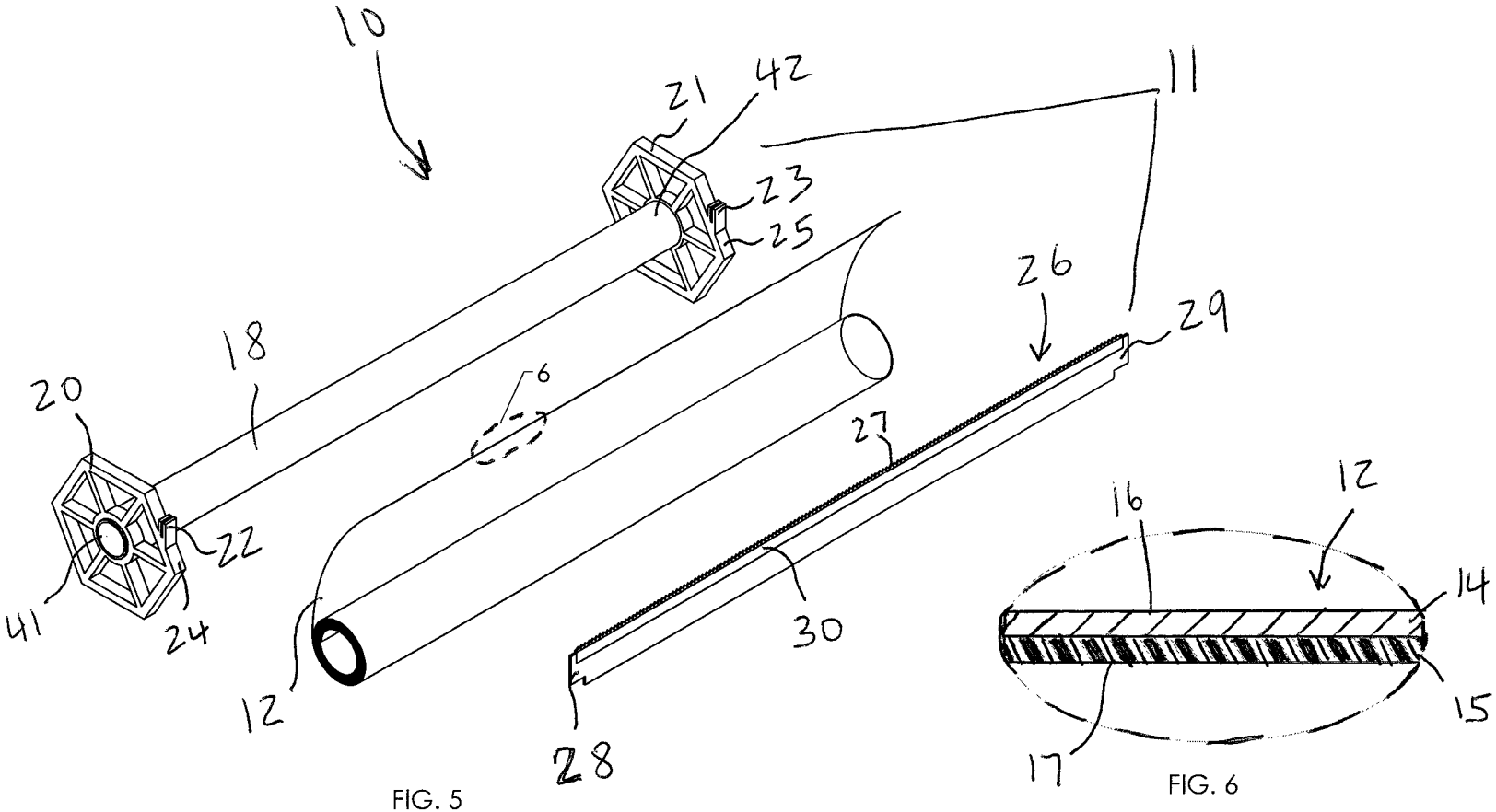
FIG. 5 is an exploded view of the aluminum and plastic food wrap dispensing apparatus shown in FIG. 1.
FIG. 6 is an enlarged cross-sectional view of the aluminum and plastic food wrap taken at section 6 in FIG. 5.

The non-limiting exemplary embodiment(s) is/are referred to generally in FIGS. 1-6 and is/are intended to provide an aluminum and plastic food wrap dispensing apparatus 10 including two separate plies (i.e., aluminum 14 and plastic 15) bonded together to create the ideal food wrapping material having a double-ply composition (e.g., body 12) formed from aluminum foil 14 and plastic cling film 15. It should be understood that the exemplary embodiment may be used to wrap many different types of food, and should not be limited to any particular food described herein.

The aluminum and plastic food wrap dispensing apparatus 10 includes a dispenser 11, and a double-ply body 12 having a foil layer 14 and a plastic layer 15 directly attached thereto wherein the double-ply body 12 has a smooth top surface 16 and a smooth bottom surface 17. Such a double-ply body 12 is in rotatable communication with the dispenser 11 such that the double-ply body 12 is freely unrolled when pulled away from the dispenser 11.

In a non-limiting exemplary embodiment, the dispensing apparatus 10 further includes a carrying case 13. Notably, the dispenser 11 is removably housed within the carrying case 13, and remains statically seated within the carrying case 13 while the double-ply body 12 is rotatably unwound from the dispenser 11.

In a non-limiting exemplary embodiment, the foil layer 14 includes aluminum foil (collectively at 14).

In a non-limiting exemplary embodiment, the plastic layer 15 includes plastic cling film (collectively at 15) having adhesive characteristics adhered to the aluminum foil 14.

In a non-limiting exemplary embodiment, the aluminum foil 14 is bonded to the plastic cling film 15.

In a non-limiting exemplary embodiment, the aluminum foil 14 is laminated to the plastic cling film 15.

In a non-limiting exemplary embodiment, the dispenser 11 includes a linear spool 18 traveling along a major longitudinal length 40 of the carrying case 13. First and second anchors 20, 21 are statically affixed to proximal and distal ends 41, 42 of the linear spool 18 respectively. Each of the first and second anchors 20, 21 includes a slot 22, 23 respectively extending outwardly and away from an outer perimeter wall 24, 25 thereof, respectively. A cutting blade 26 has serrated teeth 27 juxtaposed side-by-side along a linear travel path of the cutting blade 26, and extending parallel to a longitudinal length of the spool 18. In this manner, proximal and distal ends 28, 29 of the cutting blade 26 are removably nested within a corresponding one of the slots 22, 23.

In a non-limiting exemplary embodiment, anterior and posterior sides 30, 31 of the cutting blade 26 are registered parallel to each of the slots 22, 23 such that the double-ply body 12 traverses the serrated teeth 27 when unrolled from the spool 18. Advantageously, each of the slots 22, 23 is registered along a vertical plane 33 and the double-ply body 12 is extracted from the carrying case 13 along a general horizontal plane 34.

In a non-limiting exemplary embodiment, the double-ply body 12 includes a single sheet of the aluminum foil 14 and a single sheet of the plastic cling film 15 abutted thereagainst in a continuous roll wound to a cylindrical configuration.

The present disclosure further includes a method of utilizing an aluminum and plastic food wrap dispensing apparatus 10. Such a method includes the steps of: providing a dispenser 11; providing a double-ply body 12 having a foil layer 14 and a plastic layer 15 directly attached thereto wherein the double-ply body 12 further has a smooth top surface 16 and a smooth bottom surface 17; and rotatably communicating the double-ply body 12 with the dispenser 11 such that the double-ply body 12 is freely unrolled when pulled away from the dispenser 11.

Referring to the figures in general, in a non-limiting exemplary embodiment, a food wrap includes two separate plies (collectively at 14, 15) bonded together to create a food wrapping material having a double-ply composition (body 12) formed from aluminum foil 14 and plastic cling film 15. The two separate plies 14, 15 are heat-bonded together to wherein one ply is composed of aluminum foil 14, and the other of plastic cling film 15. A laminating process is applied to secure the two elements 14, 15 together, ensuring that they remain bonded even in the extreme heat of a full-temperature convection oven. The plastic wrap 15 used in the construction is rated as safe for food use, as is the foil 14, so that either side of the material may be placed in closer contact with the food, depending on the particular application required.

In a non-limiting exemplary embodiment, the aluminum and plastic food wrap 12 is packaged and shipped in a specialized rectangular box (carrying case 13) that includes covered, removable cutting teeth 27 along one edge of blade 26. These teeth 27 allow for simple, two-handed operation allowing the user to grab the aluminum and plastic food wrap 12 with both hands, pull out a length adequate to satisfy the current wrapping needs, and sever it from the roll by pulling it against the teeth 27. The teeth 27 are covered by a protective flap to prevent user injury, and are easily removable when even greater safety is required.

Using the aluminum and plastic food wrap 12 to seal in moisture and freshness requires only half the work involved in a conventional two-stage wrapping process. The user need simply tear off a single sheet 12 in the appropriate dimensions and wrap it securely around the food to be stored or braised. This process is uncomplicated and results in serious time savings when preparations involving hundreds or thousands of individual servings are undertaken, as is often the case in large institutional kitchens.

The aluminum and plastic food wrap 12 is designed to replace both plastic cling film and aluminum foil thereby decreasing the number of rolls of material cluttering up the shelves and surfaces of any kitchen. It offers a convenient way to provide immediate, complete moisture and flavor seal that effectively resists cross contamination and prevents food from spilling and drying out. When applied prior to the cooking process, it locks the moisture into the heart of the food, preventing it from evaporating and escaping out into the cooking apparatus.

The aluminum and plastic food wrap 12 is as easy to remove as it is to apply. Unwrapping dishes covered in the material requires only a single step, unlike unwrapping dishes clothed in multiple layers of differing materials, which can be cumbersome and even dangerous to unwrap, as escaping steam from beneath the inner layer can easily scald and otherwise injure careless kitchen staff. The aluminum and plastic food wrap 12 all comes off as a single sheet, offering a solid aluminum foil 14 barrier to help protect hands from the inevitable swelling and sweltering of the inner, heated cling film 15. Kitchen workers can remove the entire wrapping with one hand, and the product is easily disposable; the hot, wet inner layer may be simply rolled up inside the aluminum foil 14 and deposited directly into the waste receptacle, if it is no longer pristine enough to be reused.

Reusability is heightened by the aluminum and plastic food wrap's 12 composite construction. Whereas separate aluminum foil and plastic cling film layers often quickly become balled up, soiled and difficult to re-apply in other settings, the aluminum and plastic food wrap's unique construction makes it harder to inadvertently foul up and much easier to reuse in new and different applications. This reusability provides a valuable economic incentive that kitchen mangers can enjoy alongside the other labor savings implicit in the use of the product.

The aluminum and plastic food wrap 12 offers several distinct advantages over the common food service standard of cling film and then aluminum foil. Its intelligent construction (collectively 14, 15) makes wrapping large numbers of individual dishes simple and time effective. It offers a higher level of food preservation, while at the same time increasing food handler safety. The use of aluminum and plastic food wrap 12 decreases the number of boxes and rolls of packaging material that clutter up scant space in kitchen environments, and the two-ply nature of the material make it much more effective for re-using in multiple applications, thereby cutting down on general kitchen overhead.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An aluminum and plastic food wrap dispensing apparatus, comprising:

a carrying case; and a dispenser removably positioned within said carrying case including:

a linear spool extending substantially the full width of said carrying case, first and second anchors releasably affixable to first and second ends of said linear spool and each including a slot extending outwardly and away from an outer perimeter wall of said anchors, said slot being for mounting a cutting blade, a cutting blade having serrated teeth mounted directly to said slot; and a double-ply body roll comprising a rolled sheet body formed of an aluminum foil layer and a plastic layer attached thereto;

said double-ply body roll being in rotatable communication with said dispenser such that said double-ply body is freely unrolled when pulled away from said dispenser and the dispenser is capable of remaining statically seated within said carrying case while the double ply body is unrolled.

2. The aluminum and plastic food wrap dispensing apparatus of claim 1, wherein said plastic layer comprises: plastic cling film having adhesive characteristics adhered to said aluminum foil.

3. The aluminum and plastic food wrap dispensing apparatus of claim 2, wherein said aluminum foil is bonded to said plastic cling film.

4. The aluminum and plastic food wrap dispensing apparatus of claim 3, wherein said aluminum foil is laminated to said plastic cling film.

5. The aluminum and plastic food wrap dispensing apparatus of claim 1, wherein anterior and posterior sides of said cutting blade are registered parallel to each of said slot such that said double-ply body traverses said serrated teeth when unrolled from said spool; wherein each of said slot is registered along a vertical plane and said double-ply body is extracted from said carrying case along a general horizontal plane.

* * * * *